US005088422A

United States Patent [19]

Koenig

[11] Patent Number: 5,088,422

[45] Date of Patent: Feb. 18, 1992

[54] ROTARY ISOLATION DOOR

[76] Inventor: Larry E. Koenig, Komar Industries, Inc. 4425 Marketing Pl., Pickerington, Ohio 43125

[21] Appl. No.: 632,766

[22] Filed: Dec. 21, 1990

[51] Int. Cl.[5] ..... F23M 7/00

[52] U.S. Cl. ..... 110/173 R; 110/116; 110/255; 251/302

[58] Field of Search ..... 110/116, 117, 110, 173 R, 110/255, 256, 109, 173 C; 251/302, 58, 163

[56] References Cited

U.S. PATENT DOCUMENTS

| | | | |
|---|---|---|---|
| 3,255,772 | 6/1966 | Williams | 251/302 |
| 3,788,346 | 1/1974 | Fitzgerald | 251/302 X |
| 4,003,714 | 1/1977 | Foglino et al. | 110/173 R X |
| 4,366,802 | 1/1983 | Goodine | 110/116 X |
| 4,587,989 | 5/1986 | Mayhew, Jr. | 251/302 X |
| 4,774,856 | 10/1988 | Michimae et al. | 110/256 |

*Primary Examiner*—Edward G. Favors
*Attorney, Agent, or Firm*—Thompson, Hine and Flory

[57] ABSTRACT

A rotary isolation door for use in a conduit extending between an auger feeder and an incinerator which opens to allow the auger feeder to convey material to the incinerator and closes to prevent burn-back of material in the conduit from the incinerator. The door includes a first housing plate having a first opening offset from its center, An annular spacer-plate attached to the first housing plate, and a second housing plate having a second opening offset from its center and attached to the side of the spacer plate opposite the first housing plate. The first, second and spacer plates are attached to form an interior chamber within which is rotatably mounted a door plate having an offset opening such that a flow path is formed when the openings of the first and second housing plates and door plate are aligned. The door plate is fixed to a central drive shaft which is rotatably supported by the housing plates, and is rotated by cylinder motors pivotably attached to a lug extending sidewardly from the spacer plate. A lubrication system injects a lubricant into the interior chamber under pressure so that lubricate flows radially outwardly to the flow path to minimize accumulation of particulate contaminants within the interior chamber.

19 Claims, 4 Drawing Sheets

ROTARY ISOLATION DOOR

BACKGROUND OF THE INVENTION

The present invention relates to conduit systems for conveying hazardous waste material to incinerators, waste containers and the like and, more particularly, to gate valves integral with such conduit systems.

With availability of suitable sites for land fills near heavily populated areas diminishing, the use of incinerators as a means of safely disposing of waste becomes more desirable. In order to feed such incinerators efficiently and to comminute waste material to promote high-temperature combustion, auger shredders are used to feed such incinerators. For example, U.S. Pat. Nos. 4,253,615; 4,938,426 and 4,915,038 disclose auger shredders appropriate for use in feeding incinerators. Such auger shredders typically comminute or shred waste material into smaller particles, compress the material and force it into a feed conduit connected to the incinerator. The material forms a plug within the conduit which often acts as a barrier between the incinerator and the auger shredder to prevent burn back of the material through the conduit and the escape of hazardous gases through the conduit.

However, in may become necessary to effect a positive closure of the conduit connecting the auger shredder and incinerator such as, for example, when the auger shredder is not operating and the plug of material within the conduit is not moving toward the incinerator. Such closures typically take the form of a slide valve in which a flat plate slides into and out of alignment with the conduit to close and open, respectively, the passage between the auger shredder and the incinerator.

A disadvantage with such types of valves is that the material conveyed by the conduit quit often is hazardous, corrosive and includes abrasive particulates which can collect in the cavity occupied by the sliding member of such valves and corrode or otherwise jam the valve and valve plate.

Other types of valves are known, such as cut-off or gate valves. Such valves are disclosed in U.S. Pat. Nos. 1,099,200; 2,360,389; 3,047,006 and 3,237,916. Each of the valves disclosed in the aforementioned patents comprises a pair of housing members joined to each other at their peripheries to define a valve chamber which encloses a valve plate. The housing members are connected to a conduit so that material is directed through the conduit and a flow path in the valve body. The valve plate itself, or an orifice in the valve plate, is pivoted into and out of alignment with the flow path through the valve to open and close the valves.

However, a disadvantage with each of the aforementioned valves is that the action of opening and closing the valve by pivoting the valve plate acts to slice the plate through the plug of material in the flow path through the valve and displace a portion of that material into the valve chamber. Successive cycling of the valve plate causes the chamber to become full of such material, necessitating the manual removal of such material, which may be corrosive, toxic or otherwise hazardous.

Accordingly, there is a need for a valve which is suitable for use in an incinerator feed conduit, provides a positive closure and yet does not require frequent cleaning. Further, such a valve must be resistant to jamming and the accumulation of particulate material.

SUMMARY OF THE INVENTION

The present invention is a rotary isolation door which is specially designed for use with a conduit of the type used for conveying hazardous liquid, gaseous and particulate material, including radioactive material, from an auger shredder to an incinerator. The door includes a first housing plate having a first opening offset from its center, a second housing plate having a second opening offset from its center and an annular spacer plate attached to the first and second housing plates at their peripheries to define an interior chamber. A door plate is rotatably mounted within the interior chamber and includes a door opening which, upon rotation of the door plate, moves into and out of alignment with the openings in the housing plates, thereby opening and closing a flow path through the door.

In a preferred embodiment, the opening in the door plate includes an annular blade mounted about a periphery of the door plate opening to facilitate shearing through material in the flow path as said door plate is rotated to a closed position. Also in the preferred embodiment, the housing plates include shear rings attached to their openings to interact with the annular blade of the door plate to provide a shearing action during closing of the isolation door. The annular blade and shear rings are removable and replaceable when worn.

Also in the preferred embodiment, the spacer plate includes a sidewardly-extending lobe which supports cylinder motors that extend to a drive shaft connected to the door plate. Preferably, a pair of cylinder motors are utilized, and are arranged on opposite sides of the lobe, thereby eliminating any bending moment which may result during the opening and closing of the isolation door.

The preferred embodiment also includes a lubrication system in which lubricant under pressure is injected into the interior chamber to lubricate the drive shaft and to flow radially outwardly to the flow path. This flow of lubricant reduces the accumulation of contaminants within the interior chamber since it tends to collect contaminants and is removed from the isolation door by the passage of material through the flow path.

The interior chamber preferably is disk-shaped and the door plate preferably is disk-shaped as well, and sized to occupy substantially the entire chamber. Consequently, there are no voids within the interior chamber which may become jammed with contaminants, and the close tolerances between the door plate and housing members minimize the accumulation of such contamination of such contaminants. Consequently, the frequency of cleaning is minimized.

Accordingly, it is an object of the present invention to provide a rotary isolation door which is sufficiently rugged to close through a plug of corrosive, abrasive and toxic material of the type which may be conveyed by an auger shredder to an incinerator; a rotary isolation door in which the components contacting the plug of material are wear-resistant and replaceable; a rotary isolation door which is designed to eliminate voids and gaps may collect material and necessitate frequent cleaning; and a rotary isolation door having a lubrication system which further minimizes the accumulation of contaminants within the isolation door.

Other objects and advantages of the present invention will become apparent from the following description, the accompanying drawings and the appended claims.

DETAILED DESCRIPTION

Figure 1:
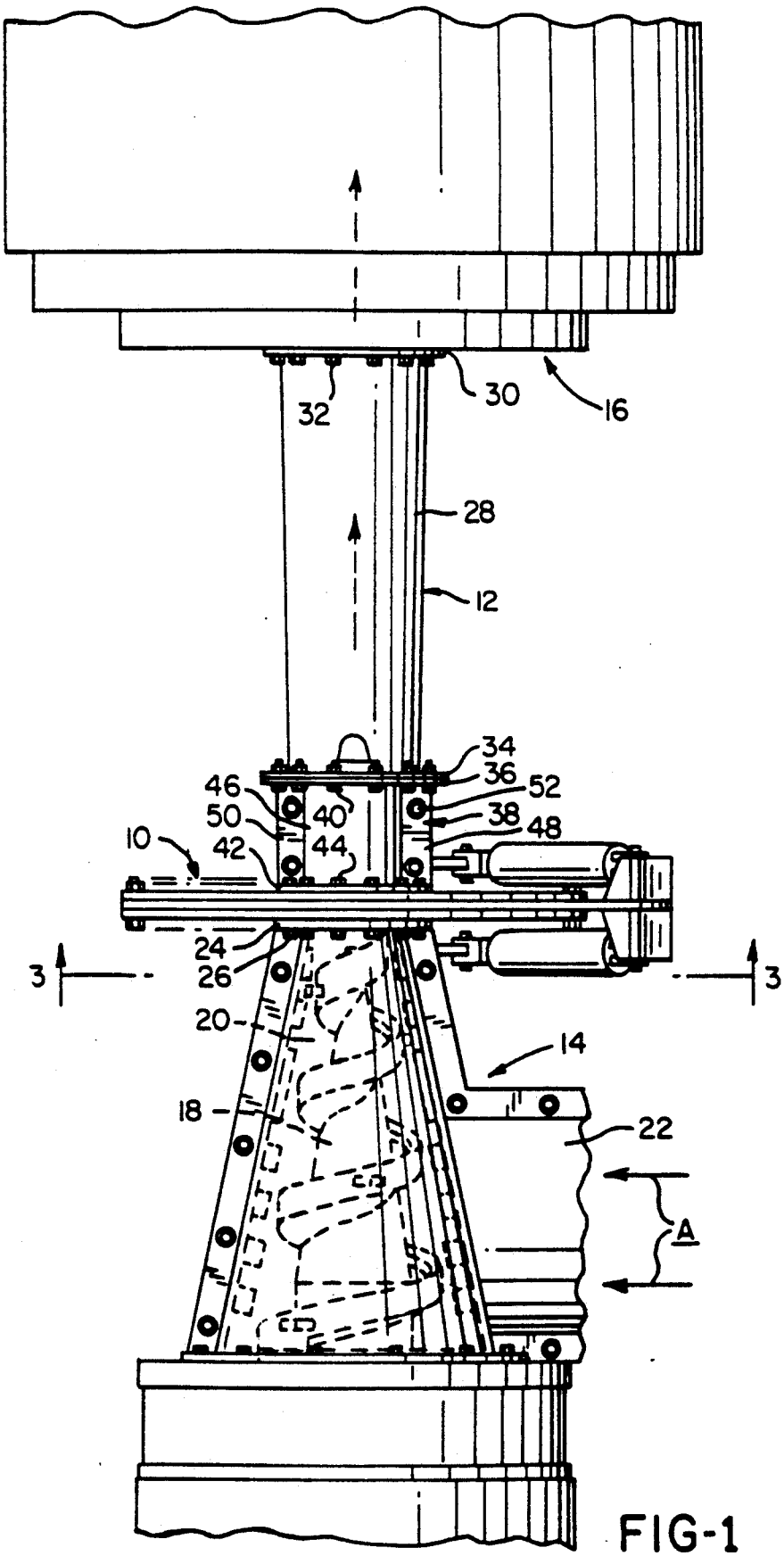
FIG. 1 is a schematic top plan view of a preferred embodiment of the rotary isolation door of the present invention, shown connected to a feed conduit extending between an auger shredder and an incinerator.

As shown in FIG. 1, the rotary isolation door of the present invention, generally designated 10, is designed to be connected to the feed conduit 12 extending between an auger shredder 14 and an incinerator 16. The auger shredder 14 includes a tapered, conical auger 18 rotatably mounted within a correspondingly-tapered grinding chamber 20. A feed tube 22 intersects the grinding chamber 20 at a rearward end thereof. The forward end of the chamber 20 includes a flange 24 which is connected to the isolation door 10 by bolts 26.

The feed conduit 12 includes a main body 28 which is continuous and flares radially outwardly along its length from the door 10 to the incinerator 16. Main body 28 is connected to the incinerator 16 at a flange 30 by bolts 32. Alternately, main body 28 could be connected by a rubber boot to incinerator 16, or simply be inserted into an appropriately sized orifice.

The opposite end of the main portion 28 is connected at flange 34 to flange 36 of resistor portion 38 by bolts 40. Transition portion 38 is, in turn, connected at an opposite flange 42 to isolation door 10 by bolts 44. Resistor portion 38 is divided longitudinally into two pieces, the upper piece 46 having longitudinal flanges 48, 50 which matingly engage with corresponding longitudinal flanges of a complementary lower portion (not shown) and are secured thereto by bolts 52. Resistor portion 38 is sized to create a plug of material pumped by auger shredder 14 to provide a block in conduit 12 to prevent a back flow of gases when door 10 is open. Resistor portion 38 also may be flared in a downstream direction.

Figure 2:
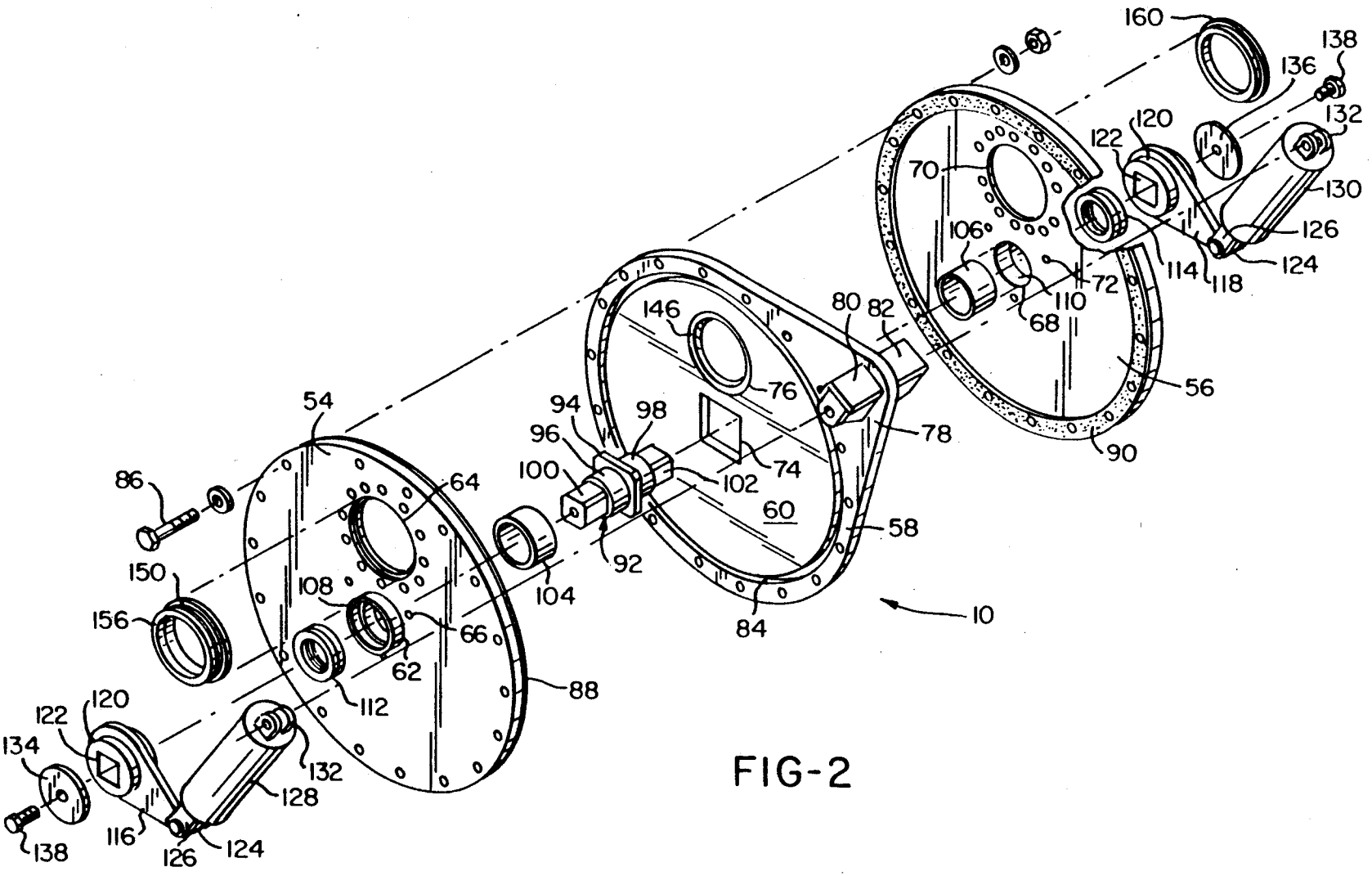
FIG. 2 is a perspective exploded view of the rotary isolation door of FIG. 1.

As shown in FIG. 2, the rotary isolation door 10 includes a first disk-shaped housing plate 54, a second disk-shaped housing plate 56, an annular spacer plate 58 and a disk-shaped door plate 60. Housing plate 54 includes a central opening 62, concentric with the plate, and an opening 64 offset from the center. Plate 54 also includes three lubrication ports 66 which extend through the plate.

Similarly, plate 56 includes a central opening 68, offset opening 70 and lubrication ports 72. Door plate 60 includes a square opening 74 centered on the plate and a round opening 76 offset from the center. Housing plates 54, 56 and door plate 60 are machined to have smooth surfaces to provide a closer fit and prevent accretion of material, especially radioactive material.

Spacer plate 58 is substantially annular and includes a sidewardly-extending lobe 78 which includes a pair of longitudinally-extending supports 80, 82 each terminating in a mounting knuckle. The spacer plate 58 defines a central opening 84 and the door plate 60 has a diameter only slightly less than the diameter of the door opening. Similarly, the thickness of the door plate 60 is slightly less than that of the spacer plate 58. Consequently, door plate 60 occupies substantially the entire volume defined by the central opening 84.

The first and second housing plates 54, 56 are attached at their peripheries to the spacer plate 58 by bolt and nut assembles 86. Annular gaskets 88, 90 are positioned at the interfaces between housing plate 54, housing plate 56 and spacer plate 58, respectively.

Figure 5:
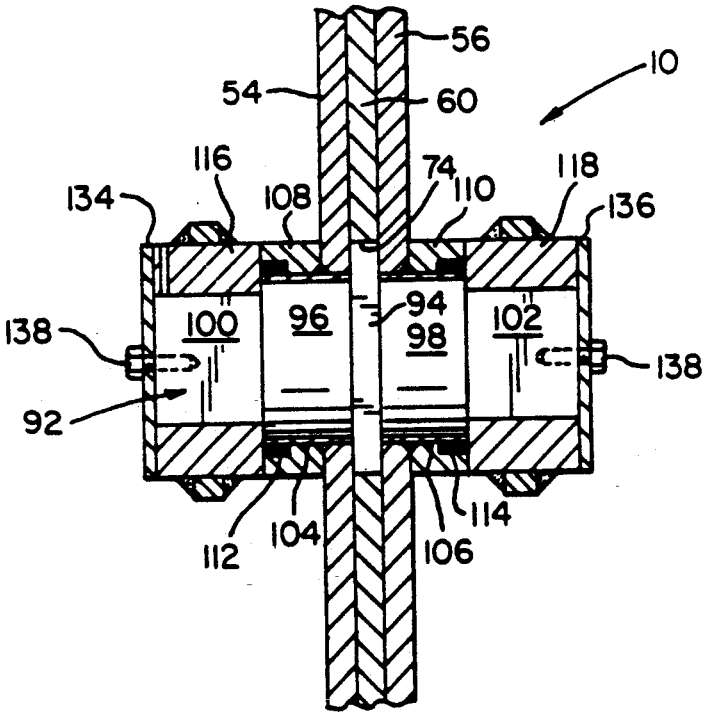
FIG. 5 is a detail in section taken at line 5—5 of FIG. 3.

As shown in FIGS. 2 and 5, a drive shaft 92 includes a central square segment 94, cylindrical segments 96, 98 adjacent to the square segment, and substantially square terminal segments 100, 102. Square portion 94 is shaped to engage square opening 74 such that rotation of drive shaft 92 causes door plate 60 to rotate. Bushings 104, 106 are shaped to slide over and engage cylindrical portions 96, 98 of the drive shaft. Collars 108, 110 are attached by welding to housing plates 54, 56, respectively, and are countersunk to receive pairs of seals 112, 114, respectively.

Torque arms 116, 118 each include a cylindrical mount 120 having a square opening 122 shaped to engage terminal square portions 100, 102, respectively. When mounted on drive shaft 92, torque arms 116, 118 extend radially and taper to a connecting knuckle 124. Connecting knuckles 124 are attached to the clevises 126 of hydraulic cylinder motors 128, 130. Cylinder motors 128, 130 have clevises 132 at opposite ends which pivotably attach to the knuckles of supports 80, 82 of the lobe 78. Disk-shaped torque arm covers 134, 136 are attached to the ends of the drive shaft 92 by bolts 138.

Figure 3:
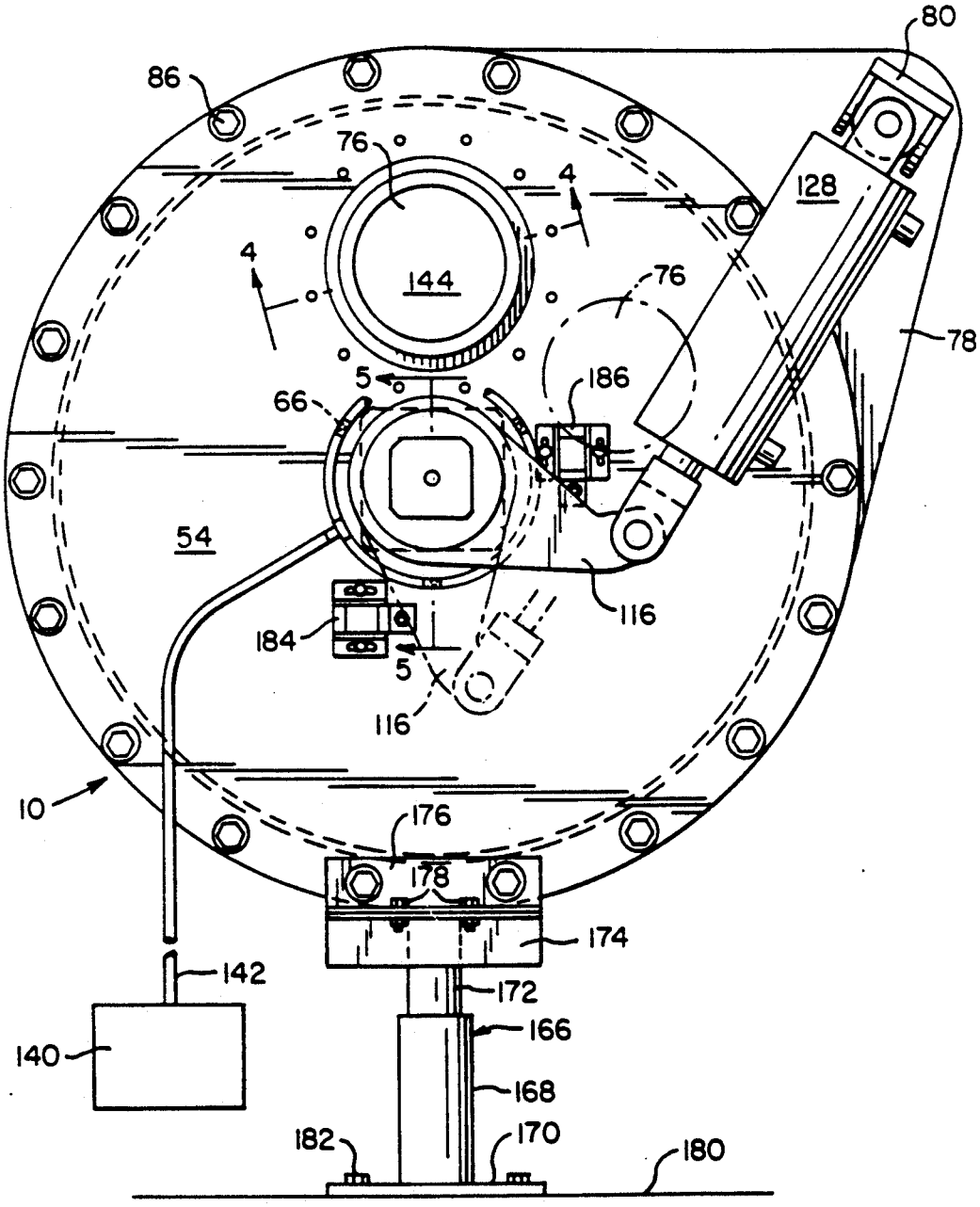
FIG. 3 is a side elevation of the rotary isolation door taken at line 3—3 of FIG. 1.

As shown in FIG. 3, a source of lubricant under pressure 140 is connected by a conduit 142 to lubrication ports 66 and 72 of the first and second housing plates 54, 56, respectively (FIG. 3 showing the connection to housing plate 54, it being understood that the connection to housing plate 56 is substantially identical). Optionally, a second lubrication connection (not shown) from source 140 may be connected to the door 10 at a location on housing plates 54, 56 opposite openings 64, 70 to purge the entire door and drive contaminants to the openings.

Figure 4:
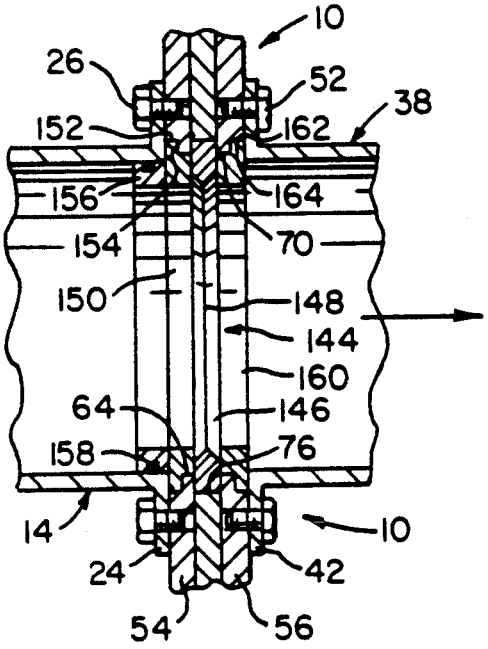
FIG. 4 is a detail in section taken at line 4—4 of FIG. 3.

As shown in FIGS. 2 and 4, registration of openings 64, 76, 70 in the housing plates and rotary door, 54, 56, 60, respectively, defines a flow path 144 through the isolation door 10, connecting the auger shredder 14 with the conduit 12. Opening 76 in door plate 60 is provided with a hardened door blade 146 extending about the inner periphery of the opening. Door blade 146 is pressed into opening 76 and is easily replaceable. Door blade 146 includes a knife edge 148 extending about the inner periphery of the blade. First housing plate 54 includes a shear blade 150 which is seated within offset opening 64. Shear blade 150 includes a peripheral lip 152 which fits within a complementary recess 154 formed in opening 64. An annular seal ring 156 is welded to the side surface of the shear blade 150 and includes an annular O-ring 158. Seal ring 156 helps provide an air and liquid impermeable seal between the auger shredder housing 14 and the door 10.

Second housing plate 56 includes a shear blade 160 having a peripheral flange 162 that is seated within a recess 164 of offset opening 70. Both shear blades 150, 160 are captured by their respective adjacent peripheral flanges 24, 42 and held in openings 64, 70. The shear blades 150, 160 and door blade 146 preferably are made of a hardened, corrosion-resistant material such as, for example, AISI 4130 alloy.

As shown in FIG. 3, the isolation door 10 includes a door stand, generally designated 166. Door stand 166 includes a base tube 168 which is welded to a foundation plate 170 and has telescoped within it an extension tube 172. Extension tube 172 is welded to base flange 174 which, in turn, is attached to door flange 176 by bolt and nut combinations 178. Foundation plate 170 is attached to a floor 180 by bolts 182. Extension tube 172 can be adjusted for the appropriate distance of the door 10 above the floor 180, then the tube 172 can be welded or otherwise fixed to the base tube 168. Alternatively, the extension tube 172 can be threaded and screwed into threads cut in the interior surface of the base tube 168 so that the extension tube can be threaded into or out of the base tube before the appropriate overall length. It should be noted that door 10 may be oriented relative to the floor 180 such that flow path 144 is at a location other than at the top of the door; the desired location being dependent upon the specific application.

The housing plates 54, 56 of door 10 also include proximity switches 184, 186 which are used to detect the extremes of rotational movement of the torque arms 114, 116 (housing plate 54 is shown in FIG. 3, it being understood that the second housing plate 56 includes proximity switches (not shown) which have the same location and perform the same function for torque arm 114). It is within the scope of the invention to provide other types of sensors, such as mechanical limit switches.

The operation of the rotary isolation door 10 is as follows. The auger shredder receives waste material through the feed tube 22 in the direction of arrows A, and the waste material is shredded and reduced in volume by action of the auger 18 and interaction of teeth on the auger with stationary braker bars mounted on the shredder housing. The material is forced through the shredder chamber 20 and through the flow path 144 of the door 10. The material continues through the transition portion 38 feed conduit 12 and into the incinerator 16.

Should it become necessary to close the conduit 12 between the auger shredder 14 and incinerator 16, the cylinder motors 128, 130 are actuated to extend their respective cylinder rods to rotate the torque arms 114, 116 and thereby rotate drive shaft 92. Rotation of drive shaft 92 causes door plate 60 to rotate from the position shown in solid lines in FIG. 3, and also shown in the exploded view of FIG. 2. As the door 60 rotates, the opening 76 moves out of alignment with the openings 64, 70 of housing plates 54, 56. The rotation of door plate 60 continues until opening 76 is rotated to the position shown in broken lines in FIG. 3. At this point, the torque arm 116 (and torque arm 114 as well, but not shown) is rotated to the position shown in broken lines in FIG. 3.

At this point, the body of the door plate 60 completely closes the flow path 144. As the plate 60 is rotated, the door blade 146 shears through the material (not shown) in the flow path 144, the door blade 166 creating a shearing interaction with shear blades 150, 160. The knife edge 148 of the shear blade 146 facilitates shearing through particularly tough or strong material.

Lubricant is pumped from source 140 through conduit 142 and into the interior chamber defined by the central opening 84 of the door 10. This lubricant migrates radially outwardly and helps drive particulate contaminants into the flow path 144 where they are carried away by the progression of material driven by the auger shredder 14. In addition, the lubricant also lubricates the rotating surfaces of the drive shaft 92.

When it is desired to reopen the flow path 144, the cylinder motors 128, 130 are actuated to draw in their respective rods, thereby causing the torque arms 114, 116 to rotate the drive shaft 92 in a direction counter to the closing direction (counterclockwise in FIG. 3) until the opening 76 again is in registry with the flow path 144 defined by openings 64, 70.

While the forms of apparatus herein described constitute preferred embodiments of the invention, it is to be understood that the invention is not limited to these precise forms of apparatus, and that changes may be made therein without departing from the scope of the invention.

What is claimed is:

1. For use with a conduit of the type used for conveying hazardous solid, liquid and gaseous material, including radioactive material, a rotary isolation door comprising:

a first housing plate having a first opening therethrough offset from a center of said first housing plate, said first opening being sized to communicate with said conduit;

a second housing plate having a second opening therethrough offset from a center of said second housing plate and being sized to communicate with said conduit, said second opening and said second plate being positioned in registry with said first opening and said first plate, respectively;

a spacer plate having an annular interior opening, said first and second housing plates being attached to opposing sides of said spacer plate such that an interior chamber is formed which communicates with said first and second openings;

a door plate rotatably mounted within said interior chamber and having a door opening displaced from a center of said plate and positionable in registry with said first and second openings, said door opening having an annular door blade mounted about a periphery thereof; and means, mounted on said isolation door, for rotating said door plate to an open position, wherein said first, second and door openings are aligned to form a flow path through said door, and to closed position, wherein said door opening blade shears through material in said flow path and said door opening is out of alignment with said first and second openings such that said door plate blocks said flow path.

2. The isolation door of claim 1 wherein said annular blade is replaceable in said door plate.

3. The isolation door of claim 1 wherein said spacer plate includes means for supporting said rotating means.

4. The isolation door of claim 3 wherein said rotating means includes drive shaft means for rotatably mounting said door plate within said cavity.

5. The isolation door of claim 4 wherein said drive shaft extends through, and is rotatably supported by, said first and second housing plates.

6. The isolation door of claim 5 wherein said rotating means includes cylinder motor means, pivotably mounted on said supporting means, for rotating said drive shaft means and thereby said door plate to said open and said closed positions.

7. The isolation door of claim 6 wherein said drive shaft includes opposing ends protruding from said first and second housing plates; and torque arm means attached to and extending radially from said opposing ends and connected to said cylinder motor means.

8. The isolation door of claim 7 wherein said supporting means includes a lobe extending sidewardly from said door; said cylinder motor means includes two hydraulic cylinder motors pivotably mounted on opposing sides of said lobe; and said torque arm means includes a pair of torque arms extending radially from opposite ends of said drive shaft such that one of said torque arms is adjacent each of said first and second housing plates and is pivotably connected to one of said hydraulic cylinder motors.

9. The isolation door of claim 8 further comprising limit switch means for detecting limits of rotating movement of said door plate to said open position and said closed position.

10. The isolation door of claim 9 wherein said limit switch means comprises a pair of proximity switches, each positioned on one of said first or second housing plates adjacent a location of one of said torque arms when said door plate is in said open position and in said closed position.

11. The isolation door of claim 1 wherein said door plate is disk-shaped and has a thickness substantially equal to that of said spacer plate.

12. The isolation door of claim 1 wherein said first and second housing plates include annular shear blades extending about inner peripheries of said first and second openings, whereby said door blade interacts with said shear blades to shear material in said flow path as said door plate is rotated to said closed position.

13. The isolation door of claim 12 wherein said shear blades are removable from said first and second housing plates.

14. The isolation door of claim 1 wherein said door blade includes an annular knife edge.

15. The isolation door of claim 1 further comprising gasket means, positioned between said spacer plate and said first and second housing plates, for providing a seal between said spacer plate and said first and second housing plates which is substantially impervious to gases, fluids and fine solids.

16. The isolation door of claim 1 further comprising lubricant purge means for supplying a lubricant to said interior chamber under pressure sufficient to drive said lubricant to said flow path where said lubricant is removed therefrom by movement of material therethrough, whereby build-up of material in said interior chamber is reduced.

17. The isolation door of claim 16 wherein said purge means comprises a plurality of inlet ports formed in said first and second housing plates and spaced about a rotational axis of said door plate.

18. The isolation door of claim 7 wherein said drive shaft is rigidly attached to said door plate and said torque arms, and rotatably attached to said first and second housing plates.

19. For use with a conduit of the type used for conveying solid, liquid and gaseous material, a rotary isolation door comprising:

a first substantially disk-shaped housing plate having a central opening and a first opening therethrough offset from a center of said first plate, said first opening being sized to communicate with said conduit;

a second substantially disk-shaped housing plate having a central opening and a second opening therethrough offset from a center of said second housing plate and being sized to communicate with said conduit, said second opening and said second plate being positioned in registry with said first opening and said first plate, respectively;

an annular spacer plate having a lobe extending sidewardly therefrom, said spacer plate being attached at opposite sides thereof to said first and second housing plates at a peripheral gas-, fluid- and fine particle-impermeable seal, thereby forming a disk-shaped interior chamber communicating with said first and second openings;

a disk-shaped door plate shaped to substantially occupy said interior chamber and having a central opening in registry with said central openings of said first and second housing plates and a door opening in registry with said first and second openings;

a drive shaft extending through said central openings and being rotatable relative to said first and second housing plates and nonrotatably connected to said door plate, said drive shaft having opposing ends protruding axially from said first and second housing plates and including torque arms fixed to and extending radially from said ends;

hydraulic cylinder motors, pivotably attached to and extending between said lobe and said torque arms, such that activation of said cylinder motors rotates said drive shaft and said door plate between an open position, wherein said first, second and door openings align to form a flow path through said door, and a closed position, wherein said door opening is out of alignment with said first and second door openings and said door plate closes said flow path;

an annular, removable door blade mounted in said door opening;

annular shear blades removably mounted in said first and second openings, said shear blades interacting with said door blade such that material in said flow path is sheared as said door plate rotates to a closed position; and lubricant purge means including a source of lubricant under pressure, a hose connected to said first and second housing plates such that said source is in fluid communication with said interior chamber, whereby lubricant flows from said source to said chamber and radially outwardly to said flow path.

* * * * *